US008531381B2

(12) United States Patent
Feng

(10) Patent No.: US 8,531,381 B2
(45) Date of Patent: Sep. 10, 2013

(54) METHODS AND SYSTEMS FOR LED BACKLIGHT WHITE BALANCE

(75) Inventor: Xiao-fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 1094 days.

(21) Appl. No.: 12/242,837

(22) Filed: Sep. 30, 2008

(65) Prior Publication Data

US 2010/0079364 A1 Apr. 1, 2010

(51) Int. Cl.
*G09G 3/36* (2006.01)

(52) U.S. Cl.
USPC ..... 345/102

(58) Field of Classification Search
USPC ..... 345/102, 690, 600, 88
See application file for complete search history.

(56) References Cited

U.S. PATENT DOCUMENTS

| | | | | |
|---|---|---|---|---|
| 6,285,350 | B1 | 9/2001 | Ijntema | |
| 6,507,159 | B2 | 1/2003 | Muthu | |
| 6,559,826 | B1 | 5/2003 | Mendelson | |
| 6,775,633 | B2 * | 8/2004 | Edge | 702/107 |
| 7,312,783 | B2 | 12/2007 | Oyama | |
| 8,289,266 | B2 | 10/2012 | Roth | |
| 2005/0103976 | A1 * | 5/2005 | Ioka et al. | 250/208.1 |
| 2005/0273390 | A1 * | 12/2005 | Hunter | 705/14 |
| 2006/0028838 | A1 * | 2/2006 | Imade | 362/602 |
| 2006/0077405 | A1 * | 4/2006 | Topfer et al. | 358/1.9 |
| 2007/0052735 | A1 * | 3/2007 | Chou | 345/690 |
| 2007/0085816 | A1 * | 4/2007 | Evanicky et al. | 345/102 |
| 2007/0091114 | A1 * | 4/2007 | Kwak et al. | 345/600 |
| 2007/0171159 | A1 | 7/2007 | Lee | |
| 2008/0036719 | A1 * | 2/2008 | Shyu et al. | 345/88 |
| 2008/0112164 | A1 | 5/2008 | Teshirogi | |
| 2008/0122832 | A1 | 5/2008 | Chen | |
| 2008/0150853 | A1 | 6/2008 | Peng | |
| 2008/0203929 | A1 * | 8/2008 | Park et al. | 315/158 |
| 2008/0246781 | A1 * | 10/2008 | Surati et al. | 345/690 |
| 2008/0246848 | A1 * | 10/2008 | Tsubaki et al. | 348/208.4 |
| 2008/0297066 | A1 * | 12/2008 | Meijer et al. | 315/291 |

FOREIGN PATENT DOCUMENTS

| | | |
|---|---|---|
| EP | 0800318 B1 | 8/1997 |
| EP | 1768083 | 3/2007 |
| JP | 2007141737 | 6/2007 |
| JP | 2007208629 A | 8/2007 |

OTHER PUBLICATIONS

International Search Report for PCT/JP2009/067438 dated Nov. 24, 2009 claiming priority to the present application.

* cited by examiner

*Primary Examiner* — Yong H Sim
(74) *Attorney, Agent, or Firm* — David C. Ripma

(57) ABSTRACT

Aspects of the present invention relate to systems and methods for performing white balance operations for an LED display backlight. Some aspects related to an iterative process wherein display backlight luminance and color are sampled at an intermediate resolution between the resolution of the LED backlight and the resolution of the LCD display. Some aspects relate to a process wherein r, g and b driving value differences are determined using a deconvolution technique.

20 Claims, 5 Drawing Sheets

METHODS AND SYSTEMS FOR LED BACKLIGHT WHITE BALANCE

FIELD OF THE INVENTION

Embodiments of the present invention comprise methods and systems for display backlight element white balance.

BACKGROUND

Some displays, such as LCD displays, have backlight arrays with individual elements that can be individually addressed and modulated. The displayed image characteristics can be improved by systematically addressing backlight array elements.

SUMMARY

Some embodiments of the present invention comprise methods and systems for performing white balance operations for an LED display backlight. Some aspects related to an iterative process wherein display backlight luminance and color are sampled at an intermediate resolution between the resolution of the LED backlight and the resolution of the LCD display. Some aspects relate to a process wherein r, g and b driving value differences are determined using a deconvolution technique.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF EXEMPLARY EMBODIMENTS

Embodiments of the present invention will be best understood by reference to the drawings, wherein like parts are designated by like numerals throughout. The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the methods and systems of the present invention is not intended to limit the scope of the invention but it is merely representative of the presently preferred embodiments of the invention.

Elements of embodiments of the present invention may be embodied in hardware, firmware and/or software. While exemplary embodiments revealed herein may only describe one of these forms, it is to be understood that one skilled in the art would be able to effectuate these elements in any of these forms while resting within the scope of the present invention.

Some embodiments of the present invention comprise systems and methods for accomplishing a white point balance process for an LED display backlight. In some embodiments, the LED white point balance can be performed without an LCD panel. In some embodiments, the white point balance can be performed with the LCD panel installed. In embodiments with the LCD panel, the LCD may be set to white to avoid an LCD gray tracking issue.

Figure 1:
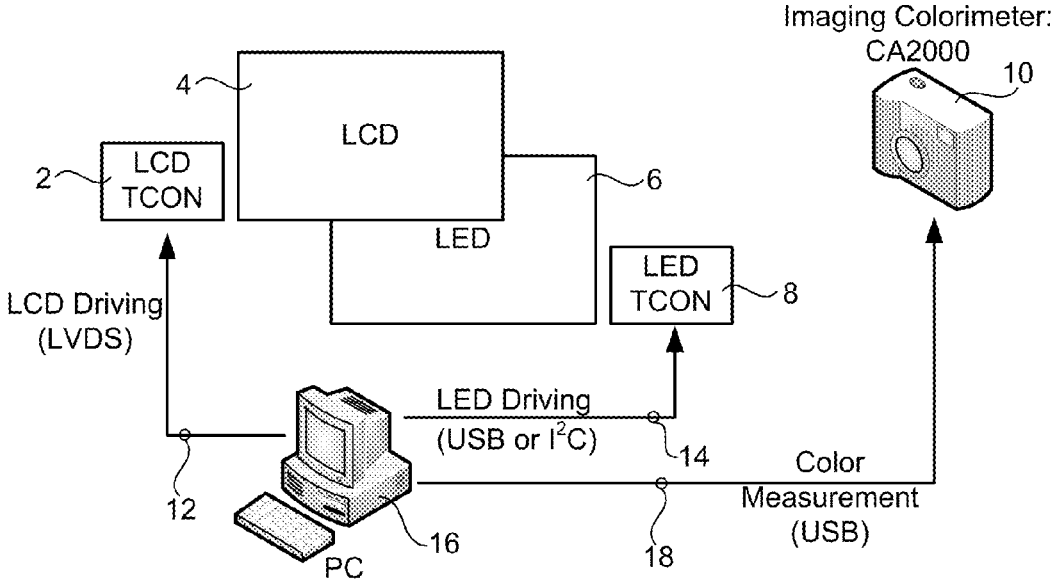
FIG. 1 is a diagram showing a typical LCD display with an LED backlight array.

Some aspects of the systems and processes involved in white point balancing may be described in relation to FIG. 1, which shows an exemplary LED white balance system. In this exemplary system, a computing device 16, such as a personal computer, may control LCD control circuitry 2 and the associated LCD 4, LED control circuitry 8 and the associated LED backlight 6 and an imaging colorimeter 10. In this exemplary system control from the computing device 16 may be achieved through connections, 12, 14 and 18, which may comprise various wired and wireless connections. In some embodiments, the imaging colorimeter 10 may be connected to the computing device 16 via a universal serial bus (USB) connection. In some embodiments, the computing device 16 may be connected to the LED control circuitry 8 with a USB connection, a video cable connection such as a digital visual interface (DVI) connection, a video graphics array (VGA) cable or some other connection 14. In some embodiments, the computing device 16 may be connected to the LCD control circuitry 2 with a USB connection, a video cable connection such as a digital visual interface (DVI) connection, a video graphics array (VGA) connection or some other connection 14. In some embodiments, the computing device 16 may be connected to the imaging colorimeter 10, LCD control circuitry 2 and/or the LED control circuitry 8 with a wireless connection.

In an exemplary white balance process, the LED backlight 6 is illuminated using initial LED driving values transmitted to the LED control circuitry 8 from the computing device 16 over a connection 14. The imaging colorimeter 10 then measures the light output from the LED panel 6 and determines the chromaticity of the backlight 6. The LCD panel 4 may or may not be present and, if present, may be set to a full white condition. Based on the measurements from the imaging colorimeter 10, the LED backlight driving values may be adjusted to correct the chromaticity of the LED backlight 6. This process may be repeated until the correct chromaticity is detected by the imaging colorimeter 10.

Some embodiments of the present invention may be described with reference to FIG. 2, which shows a flow chart of an exemplary white balance algorithm for an LED display backlight. Initially, display parameters 20 may be established for the display. These display parameters may comprise geometric display parameters, such as the size, shape, orientation and number of LED blocks and/or LCD pixels. Geometrical calibration 22 may also be performed between the captured camera data and the display. In some embodiments, geometrical calibration 22 may comprise correlating captured camera/colorimeter pixels to display LED positions.

In some embodiments, color calibration 24 may also be performed. The color calibration process 24 may comprise calculation of one or more color conversion matrices, such as an RGB to XYZ matrix and its inverse XYZ to RGB matrix.

Following color calibration 24, an iterative process 25 may be followed to achieve LED backlight white balance. This iterative process 25 may comprise display of the LED backlight set to a white value and measurement of the actual color of the backlight output 26. Based on the measured luminance profile, a target luminance may then be determined 28 that minimizes the visible luminance variation (Mura). This may be based on reduced sensitivity at both low spatial frequencies and high spatial frequencies of the human visual system.

In some embodiments, the target color X and Z may be computed 30 with the desired chromaticity (e.g., $x_0$ and $y_0$). An exemplary process is expressed as Equation 1, below. In some embodiments, the difference in XYZ coordinates between the measured XYZ and target XYZ may also be determined 32. An exemplary method for this step is expressed as Equation 2, below. In some embodiments, the iterative process 25 may then continue by obtaining 34 the corresponding normalized RGB, e.g., via Equation 3, below. In some embodiments, de-convolution may then be used 36 to determine the LED driving values r, g, and b, such as with the Equation 4, below.

In some embodiments, a new LED driving value may be determined 38, such as by using Equation 5, below. In some embodiments, LED driving values may be normalized 40 to the maximum pulse width modulation (PWM) so that the led driving values are not out of range.

Figure 2:
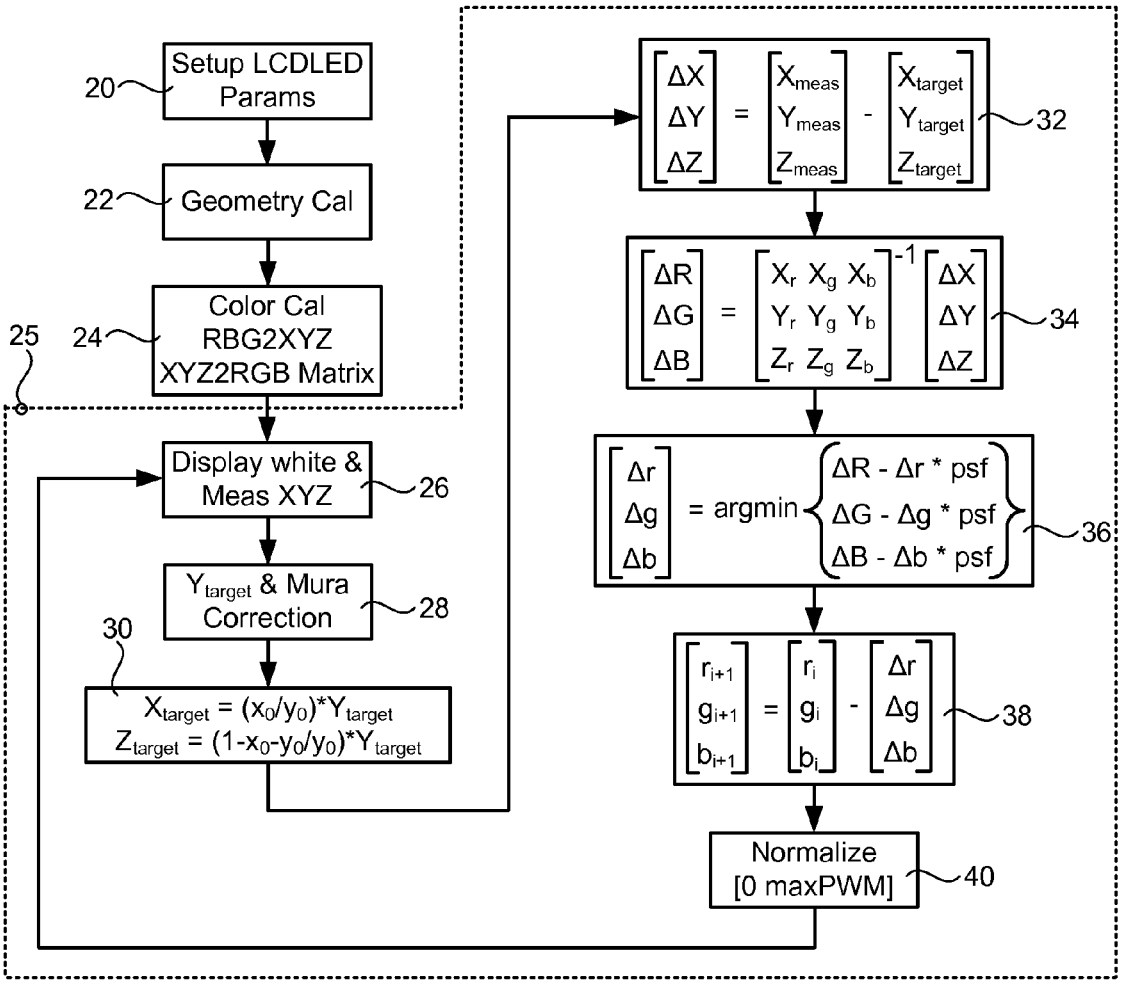
FIG. 2 is a flow chart showing exemplary steps in a white balance process of an embodiment of the present invention.

This iterative process 25, which comprises steps numbered 26 through 40 in FIG. 2, as described above, may then be repeated until the target color is reached for the LED white balance algorithm. Further details of these step are described below.

In an exemplary embodiment comprising an LCD panel 4, geometrical calibration 22 may be performed by displaying a grid pattern on the LCD 4 while the camera/colorimeter 10 captures the grid pattern and detects the grid position in the captured image.

Figure 3:
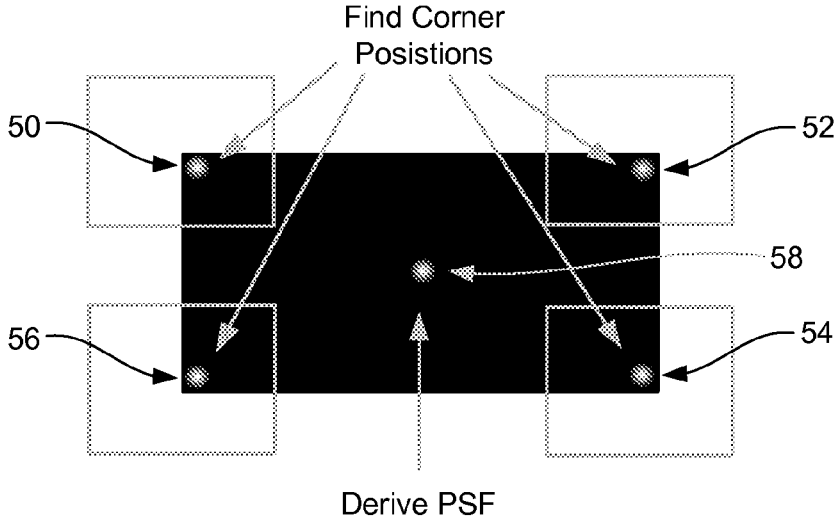
FIG. 3 is a diagram showing an exemplary test pattern of geometric display configuration.

Some aspects of some embodiments of the present invention may be described with reference to FIG. 3. In these embodiments, when no LCD 4 is present, the four corner LED blocks 50, 52, 54 and 56 may be turned on and then captured by the camera/colorimeter 10. In some embodiments, perspective transformation may be used to map the captured image to the LED backlight position. In some embodiments, in addition to the LED backlight position, a center LED 58 or another LED that is not proximate to a display edge, may also be turned on. This non-edge or center LED 58 may be used to derive the point spread function (PSF) of the LED panel 6.

In some embodiments, color calibration 24 may also be performed. The color calibration process 24 may comprise calculation of one or more color conversion matrices, such as an RGB to XYZ matrix and its inverse XYZ to RGB matrix. In some embodiments, this process may be performed using the following steps:

1. Turn on R, G, and B backlight LEDs one at a time;
2. Capture the color with a colorimeter, e.g., a CA2000 imaging colorimeter;
3. Average the measured color (XYZ) and fill the RGB2XYZ matrix;
4. Calculate the XYZ2RGB matrix as the matrix inversion of the RGB2XYZ matrix.

In another embodiment of the present invention, a XYZ2RGB and RGB2XYZ matrices may be derived for each LED by the corresponding measured color values associated with that LED.

Embodiments of the present invention may also comprise the following iterative process.

Figure 5:
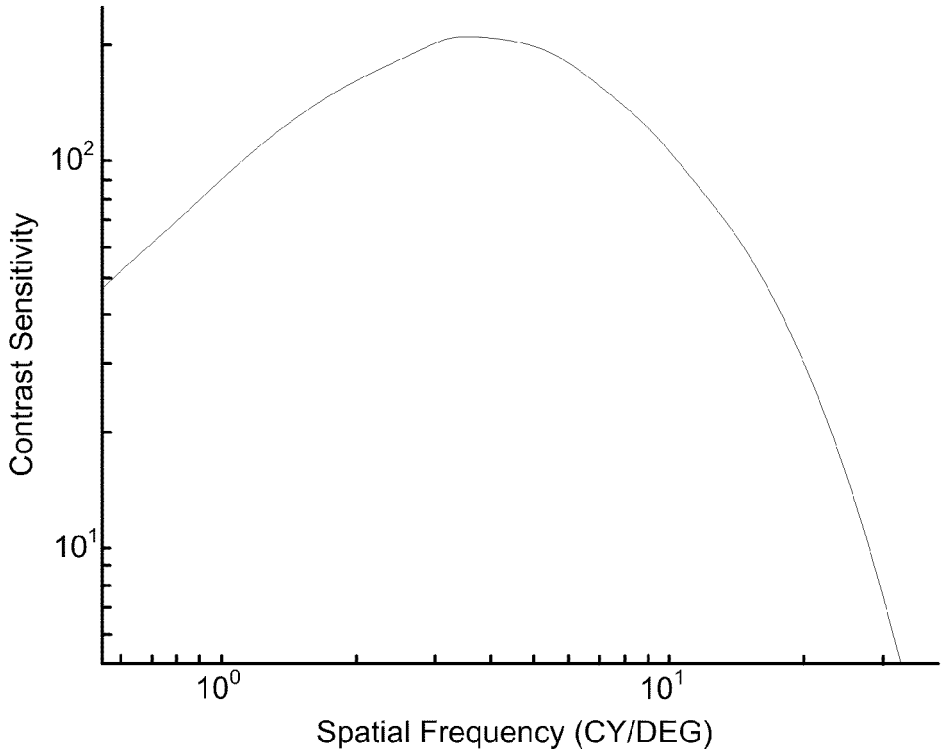
FIG. 5 is a diagram showing an exemplary contrast sensitivity function of the human visual system.

1. Display 26 (FIG. 2) the white (set R G B so that the display output is close to the target white).
2. Measure the color of the display (e.g., CIE tri-stimulus values: X, Y, Z, and CIE chromaticity x, y). Note that the measured data may have a spatial resolution higher than the LED resolution.
3. Based on the measured luminance profile, determine 28 a target luminance that minimizes the visible luminance variation (Mura). This may be based on:
   a. reduced sensitivity at both low spatial frequencies and high spatial frequencies of the human visual system as shown in FIG. 5; and
   b. there is no need to correct luminance variation that cannot be seen by human visual system.

Figure 4:
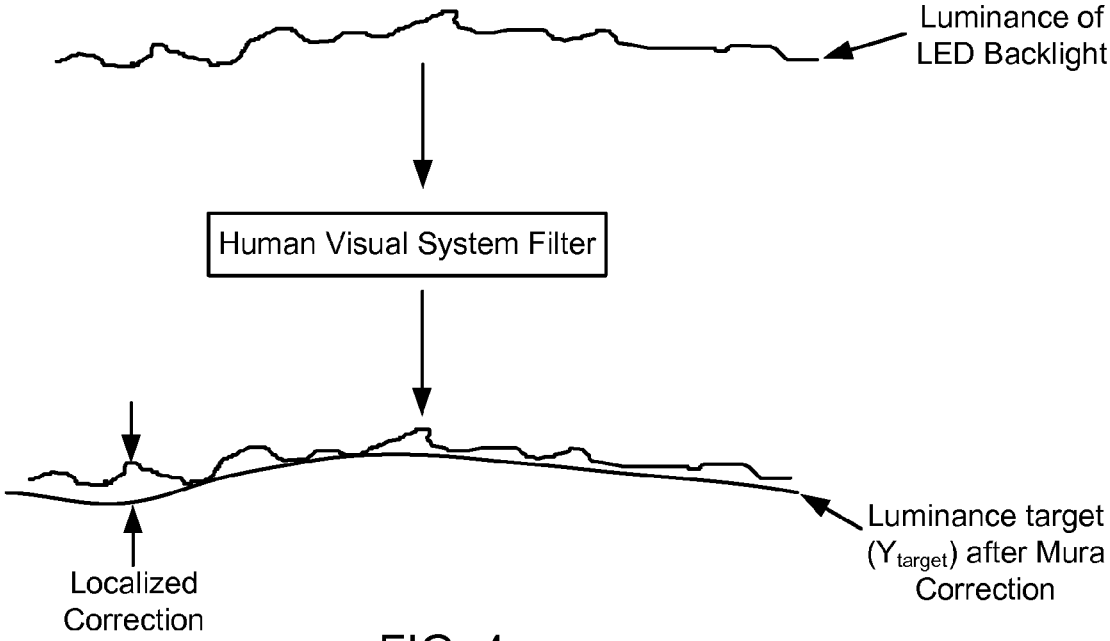
FIG. 4 is a diagram illustrating an exemplary filtering method for obtaining target luminance values.

In some embodiments, the target luminance may be set to approximately the low-pass-filtered backlight luminance as illustrated in FIG. 4.

In some embodiments, the target color X and Z may be computed 30 with the desired chromaticity $x_0$ and $y_0$ using the following equation:

$$X_{target} = \frac{x_0}{y_0} Y_{target} \qquad (1$$

$$Z_{target} = \frac{1 - x_0 - y_0}{y_0} Y_{target}.$$

In some embodiments, the difference in XYZ coordinates between the measured XYZ and target XYZ may be determined 32 with the following equation:

$$\begin{pmatrix} \Delta X \\ \Delta Y \\ \Delta Z \end{pmatrix} = \begin{pmatrix} X_{meas} \\ Y_{meas} \\ Z_{meas} \end{pmatrix} - \begin{pmatrix} X_{target} \\ Y_{target} \\ Z_{target} \end{pmatrix}. \qquad (2$$

In some embodiments, the corresponding normalized RGB may be obtained 34 with the following equation:

$$\begin{pmatrix} \Delta R \\ \Delta G \\ \Delta B \end{pmatrix} = \begin{pmatrix} X_r & X_g & X_b \\ Y_r & Z_g & Y_b \\ Z_r & Z_g & Z_b \end{pmatrix}^{-1} \begin{pmatrix} \Delta X \\ \Delta Y \\ \Delta Z \end{pmatrix}. \qquad (3$$

In some embodiments, de-convolution may be used 36 to determine the LED driving values r, g, and b with the following equation:

$$\begin{pmatrix} \Delta r \\ \Delta g \\ \Delta b \end{pmatrix} = \text{argmin} \begin{Bmatrix} \Delta R - \Delta r * psf \\ \Delta G - \Delta g * psf \\ \Delta B - \Delta b * psf \end{Bmatrix} \qquad (4$$

wherein * denotes the convolution operation.

Figure 6:
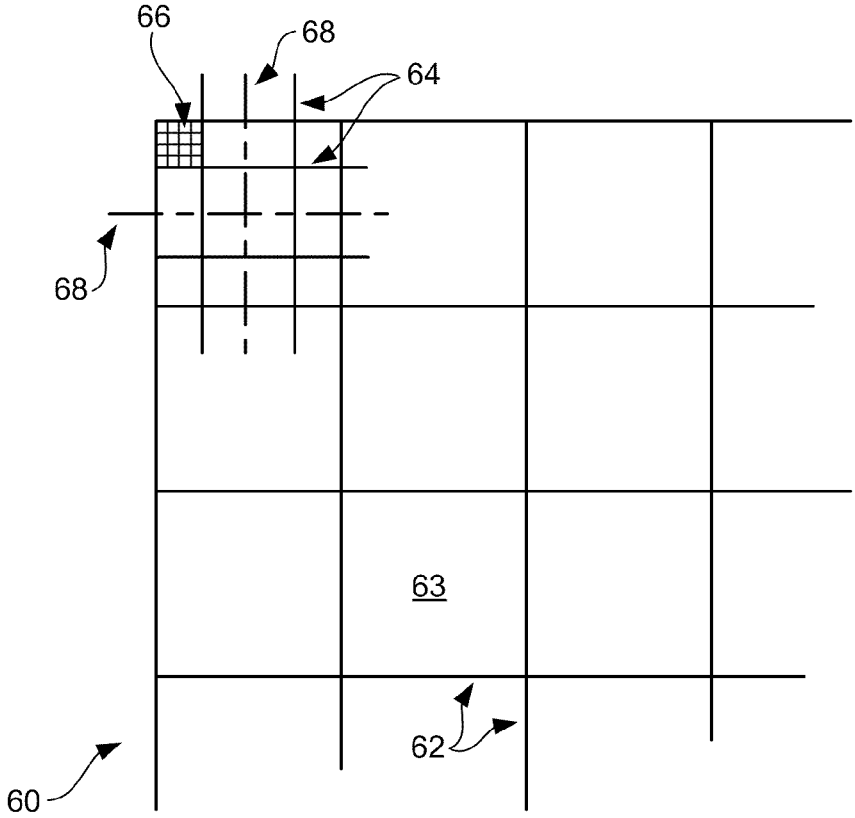
FIG. 6 is a diagram illustrating exemplary display geometry and sampling dimensions.

Aspects of some embodiments of the present invention may be explained with reference to FIG. 6, which illustrates the relative geometry of a typical display 60 and various sampling elements. The exemplary display 60 may comprise a backlight array with backlight LED elements having a size defined by backlight grid lines 62 and backlight element cells 63, which are illuminated by a backlight element, such as a single LED. The display 60 may also comprise an LCD panel with pixels 66, which are typically much smaller than the backlight LEDs 63. For the purposes of some exemplary methods of embodiments of the present invention, an intermediate grid may also be established at a resolution that is between that of the LCD pixels 66 and the backlight LED elements 63. This intermediate sampling grid may be defined by grid lines 64. In some embodiments, sampling at the intermediate resolution may be performed by downsampling the LCD pixel values. In some embodiments, the intermediate resolution elements may be qualified as on-grid or off-grid based on their proximity to an LED grid defined by grid lines 68 that pass through the center points of the LED elements. If an intermediate element is on, adjacent to, or within a specified distance of an LED grid line 68, that element may be considered to be on-grid. If the element does not meet the on-grid criterion, it is considered off-grid.

Figure 7:
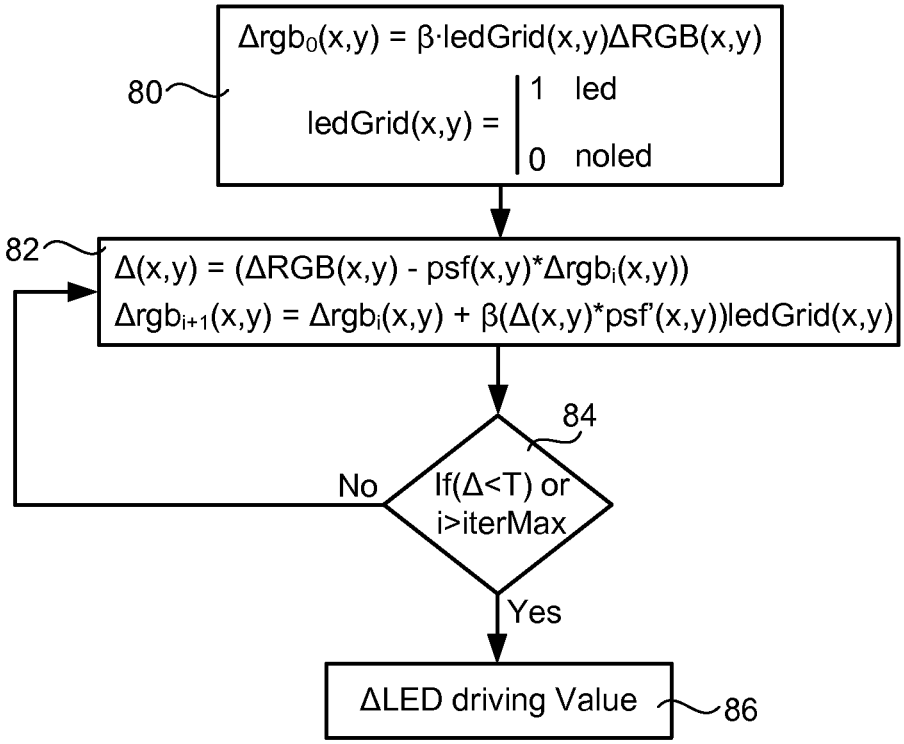
FIG. 7 is a flow chart illustrating an exemplary iterative process for determining a backlight driving value difference.

FIG. 7 further illustrates the de-convolution process. Since the de-convolution was done at a higher intermediate resolution than the LED resolution, each backlight location (x,y) is designated 80 as an LED (on-grid) location (ledGrid=1) or a no-LED (off-grid) location (ledGrid=0). The algorithm may iteratively change 82 the LED driving value (Δrgb) to minimize the difference $\{\Delta RGB(x,y)-psf(x,y)*\Delta rgb_i(x,y)\}$, where * denote the convolution operation. When a difference threshold is met 84 or a maximum number of iterations is reached, the process may be stopped and a new driving value difference is obtained 86.

In some embodiments, a new LED driving value may be determined 38 using the following equation:

$$\begin{pmatrix} r_{i+1} \\ g_{i+1} \\ b_{i+1} \end{pmatrix} = \begin{pmatrix} r_i \\ g_i \\ b_i \end{pmatrix} - \begin{pmatrix} \Delta r \\ \Delta g \\ \Delta b \end{pmatrix}. \quad (5$$

In some embodiments, LED driving values may be normalized 40 to the maximum pulse width modulation (PWM) so that the led driving values are not out of range.

Steps numbered 26 through 40 in FIG. 2, as described above, may then be repeated until the target color is reached for the LED white balance algorithm.

The terms and expressions which have been employed in the foregoing specification are used therein as terms of description and not of limitation, and there is no intention in the use of such terms and expressions of excluding equivalence of the features shown and described or portions thereof.

What is claimed is:

1. A method for display backlight white balance, said method comprising:

a) obtaining display parameters for a display, wherein said display parameters comprise geometric display parameters relating the size, shape and orientation of backlight elements and pixel elements;

b) capturing sensor data for said display, wherein said sensor data comprises backlight chromaticity;

c) performing geometrical calibration between said captured sensor data and said display, wherein said geometrical calibration comprises correlating said captured sensor data with backlight element positions using said display parameters;

d) calculating color conversion matrices for said display backlight;

e) displaying said backlight at a selected white value;

f) measuring the actual color of said backlight at said selected white value, thereby determining a measured backlight color;

g) determining a target luminance based on said measured backlight color and minimization of visible luminance variation;

h) determining a target color;

i) determining a color difference between said measured backlight color and said target color;

j) determining a normalized RGB color difference based on said color difference;

k) determining rgb color difference driving values; and l) determining new rgb driving values based on said rgb color difference values and original driving values used to display said selected white value.

2. A method as described in claim 1 further comprising normalizing said new rgb driving values.

3. A method as described in claim 1 wherein said display parameters comprise at least one parameter from the set consisting of size, shape, orientation and quantity of LED backlight elements in the display backlight.

4. A method as described in claim 1 wherein said display parameters comprise at least one parameter from the set consisting of size, shape, orientation and quantity of LCD pixel elements in the display.

5. A method as described in claim 1 wherein said capturing sensor data comprises capturing a colorimeter image of said display.

6. A method as described in claim 1 wherein said capturing sensor data comprises capturing an image of said display while said display's corner backlight elements and a backlight element that is not proximate to an edge are illuminated.

7. A method as described in claim 1 wherein said performing geometrical calibration between said captured sensor data and said display comprises correlating captured sensor data with display elements.

8. A method as described in claim 1 wherein said calculating color conversion matrices comprises illuminating red, green and blue backlight elements independently and measuring the color output for each color.

9. A method as described in claim 1 wherein said displaying said backlight at a selected white value comprises using estimated R, G and B backlight values that match a target white value.

10. A method as described in claim 1 wherein said measuring the actual color of said backlight at said selected white value comprises capturing display output with a colorimeter.

11. A method as described in claim 1 wherein said determining a target luminance comprises filtering luminance values to minimize visible luminance variation.

12. A method as described in claim 1 wherein said determining a target luminance comprises filtering luminance values with a low-pass filter with a cut-off frequency corresponding to an increase in sensitivity of the human visual system.

13. A method as described in claim 1 wherein said determining rgb color difference driving values comprises a deconvolution operation using the following relationship:

$$\begin{pmatrix} \Delta r \\ \Delta g \\ \Delta b \end{pmatrix} = \text{argmin}\begin{Bmatrix} \Delta R - \Delta r * psf \\ \Delta G - \Delta g * psf \\ \Delta B - \Delta b * psf \end{Bmatrix};$$

wherein "arg min" is an operation that yields the arguments for which the associated functions attain their minimum values and psf represents a point spread function.

14. A method for display backlight white balance, said method comprising:

a) obtaining display parameters for a display, wherein said display parameters comprise geometric display parameters relating the size, shape and orientation of backlight elements and pixel elements;

b) capturing sensor data for said display, wherein said sensor data comprises backlight chromaticity;

c) performing geometrical calibration between said captured sensor data and said display, wherein said geometrical calibration comprises correlating said captured sensor data with backlight element positions using said display parameters;

d) calculating color conversion matrices for said display backlight;

e) displaying said backlight at a selected color value;

f) measuring the actual color of said backlight at said selected color value, thereby determining a measured backlight color, said measuring being performed at an intermediate resolution between a display LED backlight resolution and a display LCD pixel resolution;

g) determining a target luminance based on said measured backlight color and minimization of visible luminance variation, said target luminance being determined at said intermediate resolution;

h) determining a target color;

i) determining a color difference between said measured backlight color and said target color, at said intermediate resolution;

j) determining a normalized RGB color difference based on said color difference, at said intermediate resolution;

k) determining rgb color difference driving values, at said intermediate resolution; and l) determining new rgb driving values based on said rgb color difference values and original driving values used to display said selected white value, said rgb driving values being determined at said display LED backlight resolution.

15. A method as described in claim 14 further comprising normalizing said new rgb driving values.

16. A method as described in claim 14 wherein said capturing sensor data comprises capturing an image of said display while said display's corner backlight elements and a backlight element that is not proximate to an edge are illuminated.

17. A method as described in claim 14 wherein said calculating color conversion matrices comprises illuminating red, green and blue backlight elements independently and measuring the color output for each color.

18. A method as described in claim 14 wherein said determining a target luminance comprises filtering luminance values to minimize visible luminance variation.

19. A method as described in claim 14 wherein said determining a target luminance comprises filtering luminance values with a low-pass filter with a cut-off frequency corresponding to an increase in sensitivity of the human visual system.

20. A method as described in claim 14 wherein said determining rgb color difference driving values comprises a deconvolution operation using the following relationship:

$$\begin{pmatrix} \Delta r \\ \Delta g \\ \Delta b \end{pmatrix} = \operatorname{argmin}\begin{Bmatrix} \Delta R - \Delta r * psf \\ \Delta G - \Delta g * psf \\ \Delta B - \Delta b * psf \end{Bmatrix};$$

wherein "arg min" is an operation that yields the arguments for which the associated functions attain their minimum values and psf represents a point spread function.

* * * * *